United States Patent [19]

Iida et al.

[11] Patent Number: 4,513,806

[45] Date of Patent: Apr. 30, 1985

[54] APPARATUS FOR WITHDRAWING SOLIDIFIED ROD IN HORIZONTAL TYPE CONTINUOUS CASTING MACHINES

[75] Inventors: Shinzo Iida; Katsuji Ie; Jun Miyazaki, all of Kobe, Japan

[73] Assignee: Kabushiki Kaisha Kobe Seiko Sho, Kobe, Japan

[21] Appl. No.: 497,017

[22] Filed: May 23, 1983

[51] Int. Cl.[3] ..... B22D 11/16; B22D 11/04

[52] U.S. Cl. ..... 164/413; 164/440; 164/454

[58] Field of Search ..... 164/413, 440, 454, 478, 164/484, 490

[56] References Cited

U.S. PATENT DOCUMENTS 3,669,176 6/1972 Krall et al. ..... 164/440

3,908,747 9/1975 Kuttner ..... 164/413

*Primary Examiner*—Kuang Y. Lin

*Assistant Examiner*—Richard K. Seidel

*Attorney, Agent, or Firm*—Oblon, Fisher, Spivak, McClelland & Maier

[57] ABSTRACT

An apparatus for drawing casting in a horizontal type continuous casting machine, which basically comprises a forward drive motor of a large capacity for driving a pair of pinch rollers in a forward direction with a large torque, a reversible constant-load motor for driving the pinch rollers in the reverse direction, a clutch for disconnectibly connecting the forward drive motor to the pinch rollers, a control circuit for engaging and releasing the clutch in response to output signals of detecting means which detect the forward and backward motions of the casting, respectively.

7 Claims, 12 Drawing Figures

APPARATUS FOR WITHDRAWING SOLIDIFIED ROD IN HORIZONTAL TYPE CONTINUOUS CASTING MACHINES

BACKGROUND OF THE INVENTION

1. Field of the Invention

This invention relates to improvements in and relating to an apparatus for withdrawing a solidified rod from a horizontal type continuous casting machine.

2. Description of the Prior Art

For withdrawing a solidified rod in horizontal casting, it has been known in the art that the quality of casting can be stabilized by slightly pushing back the rod after each withdrawal of a predetermined stroke. For this purpose, the conventional practice has been to employ a reversible motor for driving the pinch rollers which withdraw the solidified strand from the casting mold, reversing the drive motor under control to effect the forward withdrawal and push-back of the solidified rod alternately in a predetermined timing. However, with such a conventional drive system, a motor of a large capacity has to be reversed at a low torque so that it requires a complicated reversing control, coupled with the problem of slow response due to a large rotational inertia of the motor.

SUMMARY OF THE INVENTION

With the foregoing situations in view, the present invention has as its primary object the provision of a drawing apparatus for a horizontal continuous casting machine, which can switch the operation from the forward withdrawal to the push-back mode or vice versa in a facilitated and prompt manner and which is capable of controlling the forward withdrawal and push-back of the cast strand accurately.

According to a fundamental aspect of the present invention there is provided an apparatus for withdrawing cast strand in a horizontal type casting machine, which comprises a forward drive motor of a large capacity for driving a pair of pinch rollers in a forward direction with a large torque, a reversible constant-load motor for driving the pinch rollers in the reverse direction, a clutch for disconnectibly connecting the forward drive motor to the pinch rollers, a control circuit for engaging and releasing the clutch in response to output signals of detecting means which detect the forward and backward motions of the casting, respectively.

In a preferred form of the invention, the casting withdrawing apparatus employs a vacuum clutch brake for connecting and disconnecting the forward drive motor, and a roller pressure control means for controlling the gripping force of the pinch rollers to prevent slips between the cast strand and the pinch rollers, which deteriorate accurate control of the movement of the cast strand.

The above and other objects, features and advantages of the present invention will become apparent from the following description and appended claims, taken in conjunction with the accompanying drawings which show by way of example preferred embodiments of the invention.

BRIEF DESCRIPTION OF THE DRAWINGS

In the accompanying drawings

DESCRIPTION OF PREFERRED EMBODIMENTS

Figure 1:
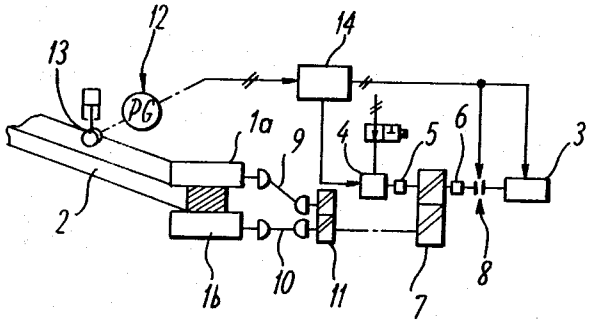
FIG. 1 is a diagrammatic view of a horizontal continuous casting machine incorporating the drawing apparatus according to the present invention.

Referring to FIG. 1, there is diagrammatically shown a horizontal type casting machine incorporating the drawing apparatus according to the present invention, including a pair of pinch rollers 1*a* and 1*b* for horizontally withdrawing or pushing back a cast strand 2, a forward-drive electric motor 3 of a large capacity for driving the pinch rollers 1*a* and 1*b* in the forward direction, and a reverse-drive air motor 4 for driving the pinch rollers 1*a* and 1*b* in the reverse direction. The motors 3 and 4 are connected to the input shaft of a reducer 7 through couplings 5 and 6, respectively. The motor 3 is disconnectibly connected to the reducer 7 by on-off operation of a clutch 8.

The output shaft of the reducer 7 is connected to a pinion stand 11 which drives the paired pinch rollers 1*a* and 1*b* in synchronism with each other through universal joints 9 and 10.

The reference numeral 12 indicates a cast strand motion detector including a pulse generator for detecting the forward and backward motions of the cast strand 2 by way of pulses which are produced in synchronism with the rotation of a measure roller 13 disposed in contact with the cast strand 2. The output signal of the motion detector 12 is fed to a control circuit 14 which switches the operation to either the forward drive by the motor 3 or the backward drive by the motor 4 as well as the on-off operation of the clutch 8, engaging the clutch 8 in a withdrawing period to drive the pinch rollers 1*a* and 1*b* in the forward direction by the forward drive motor 3, rotating the reversible air motor 4 in the inverse direction. In a push-back period, the clutch 8 is disengaged fo disconnect the forward drive motor 3 from the reducer 7, driving the pinch rollers 1*a* and 1*b* in the reverse direction at a low speed by the constant load air motor 4.

Figure 2:
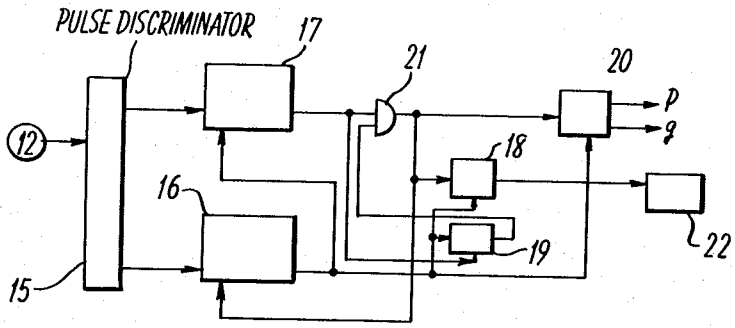
FIG. 2 is a circuit diagram of a control system for the drawing apparatus of FIG. 1.

As shown particularly in FIG. 2, the control circuit 14 is provides with: a pulse discriminator 15 which discriminates the positive and negative pulses produced by the motion detector 12; a withdrawing stroke preset counter 16 setting the amount of withdrawal, which is supplied with the positive pulses corresponding to the forward motion of the withdrawn casting 2; a push-back stroke preset counter 17 setting the push-back rate, which is supplied with the negative pulses corresponding to the backward motion of the pushed-back casting 2; a withdrawal limit timer 18 presetting the length of a casting withdrawing time T1; a push-back limit timer 19 for setting the length of a push-back time T2; and a flip-flop 20 which is adapted to produce a clutch-on signal p when it is set and to produce a clutch-off signal q when it is reset. As soon as the count of the withdrawal preset counter 16 reaches a value corresponding to a predetermined appropriate rate of withdrawal, the flip-flop 20 is reset to produce a clutch-off signal q to release the clutch 8. On the other hand, if the count of the push-back preset counter 17 reaches a value corresponding to a predetermined appropriate push-back rate or when the push-back limit timer 19 produces a time-out signal, OR gate 21 is opened to set the flip-flop 20, producing a clutch-on signal p to re-engage the clutch 8.

The withdrawal preset counter 16 is cleared by the set signal of the flip-flop 20, while the push-back preset counter 17 is cleared by the reset signal of the flip-flop 20.

Now, if the flip-flop 20 of the control circuit 14 produces a clutch-on signal p, the cluth 8 is engaged to connect the forward drive motor 3 to the reducer 7, whereupon the pinch rollers 1*a* and 1*b* are started to rotate in the forward direction and promptly reaches a predetermined speed to withdraw the casting 2. As the casting 2 is withdrawn by a predetermined amount, and the withdrawal preset counter 16 counts up, the clutch 8 is released by the clutch-off signal q to disconnect the forward drive motor 3, whereupon the casting withdrawal is decelerated and temporarily stopped. At this time, the reverse drive air motor 4 which has been rotated in the inverse direction is put in forward rotation to reverse the rotation of the pinch rollers 1*a* and 1*b*, pushing back the casting 2 in a slight degree. If the casting 2 is pushed back by a predetermined amount and the push-back preset counter 17 counts up, the flip-flop 20 is set and produces a clutch-on signal to resume the casting withdrawal.

Figure 3:
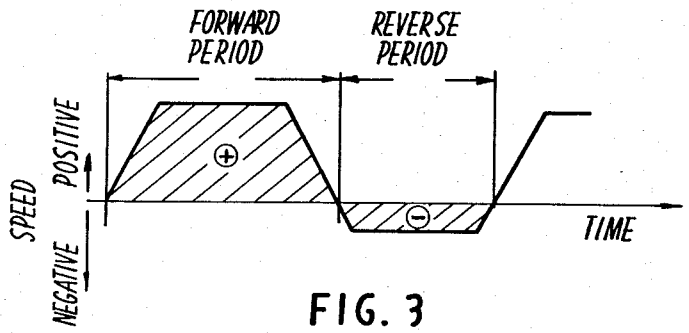
FIGS. 3 and 4 are graphic illustrations of positive and negative motions of the casting in normal and abnormal conditions, respectively.
Figure 4:
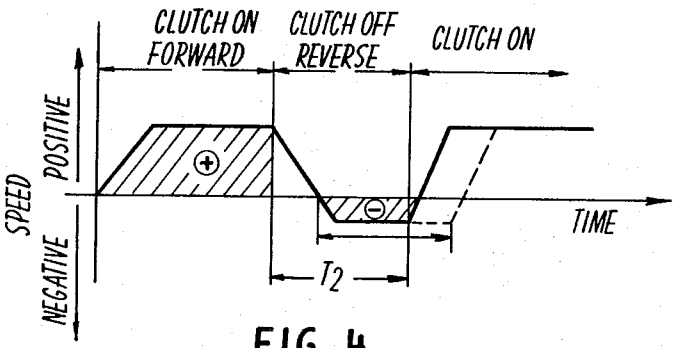

In the event the push-back limit timer 19 which is set by the reset signal of the flip-flop 20 comes to time-up upon lapse of the preset limit time T2 before the count-up of the push-back preset counter 17 for some reason as shown in FIG. 4, the OR gate 21 is opened and therefore the flip-flop 20 is set and produces a clutch-on signal to initiate the withdrawal of the casting 2.

Consequently, the push-back of the casting 2 is controlled in terms of both the push-back amount and the push-back time in order not to spend unnecessary time for the push-back operation.

On the other hand, in the event the withdrawal preset counter 16 does not count up within the withdrawing time period T1 which is preset by the withdrawing time control timer 18, it is regarded that there has occurred an abnormal situation to the withdrawing operation and the time-up signal of the timer 18 is applied to an alarm device (indicated at 22 of FIG. 2) to produce an alarm signal for notifying the occurrence of an abnormal situation.

Although the clutch 8 is engaged and released according to the output signal of the motion detector 12 which detects the amount of displacement of the cast strand 2 in the foregoing embodiment, there is a possibility that accurate control of the withdrawing and push-back amounts of the casting 2 be can be affected by a slip which might occur between the pinch rolls 1*a* and 1*b* and the casting 2. In order to avoid this, it is preferred to remove the errors due to such slips by comparing the actual motion of the casting 2 with the rotational angles of the pinch rollers 1*a* and 1*b*, increasing the gripping pressure of the pinch roller 1*a* upon detection of a slip to prevent occurrence of further slips.

Figure 5:
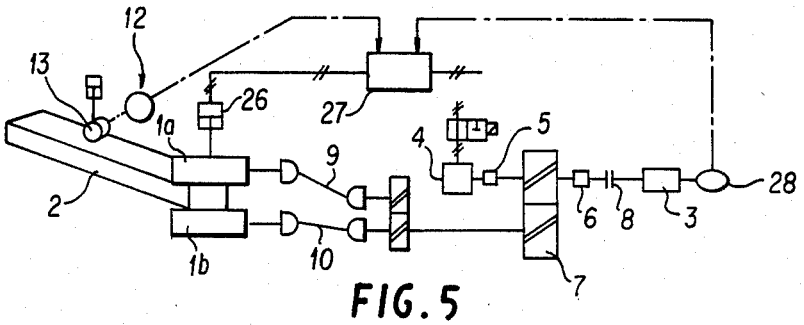
FIG. 5 is a view similar to FIG. 1 but showing another embodiment of the present invention.

To this end, the embodiment shown in FIG. 5 further includes a pressurizer 26 in the form of a pressure cylinder for applying pressure on the upper pinch roller 1*a*, and a roller pressure control 27 of controlling the pressure to be applied by the pressurizer 26, along with a rotation detector in the form of a pulse generator or other means suitable for detecting the rotational angles of the pinch rollers 1*a* and 1*b*, for example, by way of the r.p.m. of the forward drive motor, thereby controlling the gripping force of the pinch rollers for preventing the slips in the manner as will be described hereinlater.

Figure 6:
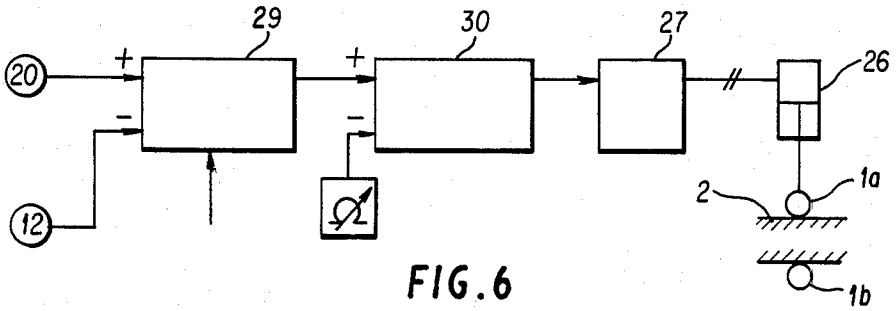
FIG. 6 is a circuit diagram of a system for controlling the pressure of pinch rollers in the embodiment of FIG. 5.

Namely, as shown particularly in FIG. 6, the output pulses of the rotation detector 28 as well as the output pulses of the motion detector 12 are simultaneously fed to a subtractor 29, which is reset by the withdrawal initiation signal (the clutch-on signal p), to compare and detect the difference between the numbers of the respective output pulses, if any. Upon detection of a difference, a corresponding signal is fed to a calculator 30 which reads in from a pressure setter 31 a pressure corresponding to the difference and send a command signal to the roller pressure control 27 to apply pressure on the pinch roller 1*a* by the pressurizer 26 to increase the gripping force to a level which can prevent the slips.

By preventing slips between the casting 2 and the pinch rollers 1*a* and 1*b* through adjustment of the pressure which is applied on the upper pinch roller 1*a*, it becomes possible to withdraw the casting constantly in a stable state since the displacement (withdrawal) of the casting 2 always corresponds to a certain angle of rotation of the pinch rollers. In FIG. 5, the component parts common to the embodiment of FIG. 1 are designated by like reference numerals.

Figure 7:
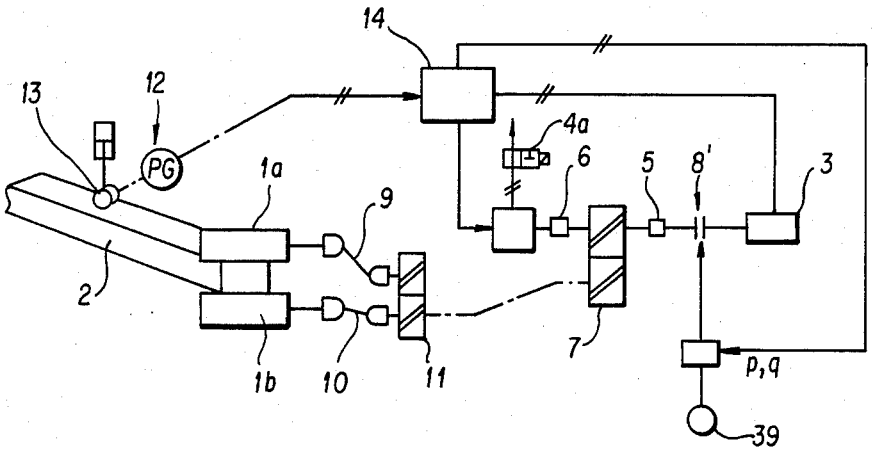
FIG. 7 is a view similar to FIG. 1 but showing a further embodiment of the invention.

Referring now to FIG. 7, there is diagrammatically illustrated a further embodiment of the invention, which is similar to the embodiment of FIG. 1 except that a vacuum clutch brake 8' is employed instead of the clutch 8. As shown particularly in FIG. 8, the vacuum clutch brake 8' has the interior of its housing 40 divided into two chambers. Accommodated in one of the chambers of the vacuum clutch brake 8' are a clutch disk 42 which is coaxially fixed to the end of the input shaft 41 of the coupling 5 and a clutch shoe 43 which is secured to the end of the output shaft 3*a* of the forward drive motor 3. The other chamber is formed into an air-tight chamber 44 and further divided into first and second vacuum chambers 46 and 47 by a diaphragm plate 45.

The diaphragm plate 45 has its inner periphery hermetically fixed on a middle portion of the input shaft 41 of the coupling 5 and has its outer periphery hermetically fixed to the inner peripheral wall of the air-tight chamber 44. The vacuum chambers 46 and 47 are respectively communicable with a vacuum source 49 through a solenoid valve 48 with three change-over positions.

Further, the diaphragm plate 45 is in the neutral flat position indicated by solid line when the solenoid valve 48 is in the center neutral position, communicating both of the first and second subchambers 46 and 47 with the atmosphere. As soon as the on-signal p is applied to the solenoid valve 48, it is displaced in the direction of arrow (a) of FIG. 8 to admit the vacuum from the vacuum source 49 into the first vacuum chamber 47, deforming the diaphragm plate 45 as indicated by broken line A in the same figure. Consequently, the clutch disc 42 is pressed against the clutch shoe 43 of the output shaft 3*a* to engage the clutch.

Figure 8:
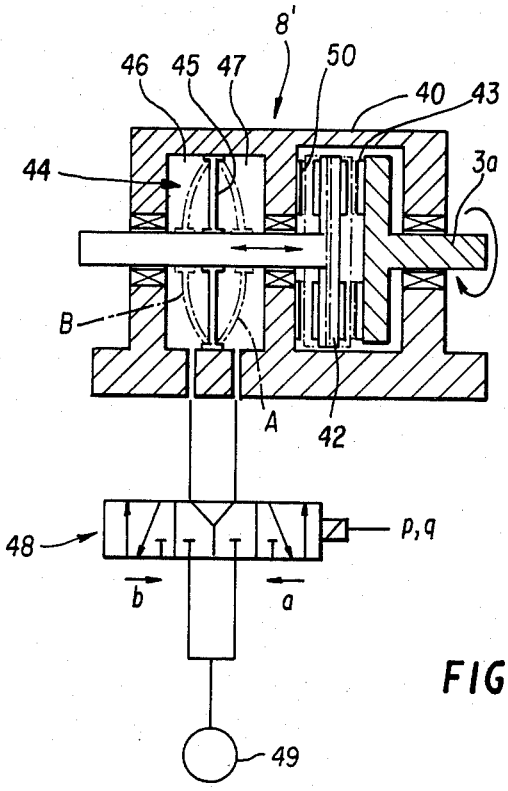
FIG. 8 is a diagrammatic sectional view of a vacuum clutch brake employed in the embodiment of FIG. 7.
Figure 9:
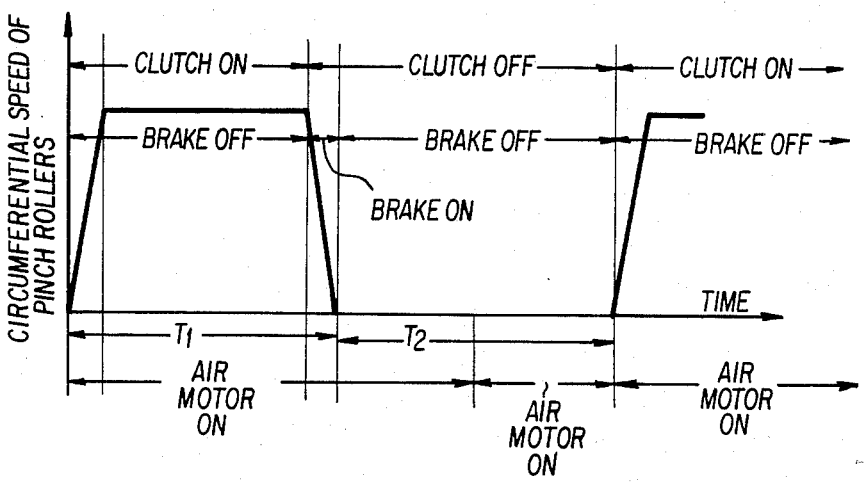
FIG. 9 is a diagram of withdrawing cycles by the embodiment of FIG. 7.

If the off-signal q is applied to the solenoid valve 48, the valve is displaced in the direction of arrow (b) to admit the vacuum into the second vacuum chamber 46, deforming the diaphragm plate 45 as indicated by broken line B in FIG. 8 to release the clutch. At the same time, a brake shoe 50 on the back side of the clutch disk 42 is pressed against a brake shoe 50 which is fixed on the partition wall of the housing, to apply brake to the forward drive motor 3. Then, the solenoid valve 48 is returned to the center neutral position to release the brake and clutch to disconnect the forward drive motor 3 from the reducer.

The operation is same as in the first fundamental embodiment shown in FIG. 1 except for the quick response accruing from the use of the vacuum clutch brake 8' as will be described in greater detail hereinlater. The push-back of the casting 2 is likewise controlled by both the preset push-back rate and push-back time, stopping the reversible air motor 4 when a predetermined push-back rate is attained before lapse of the push-back time T2.

Figure 10:
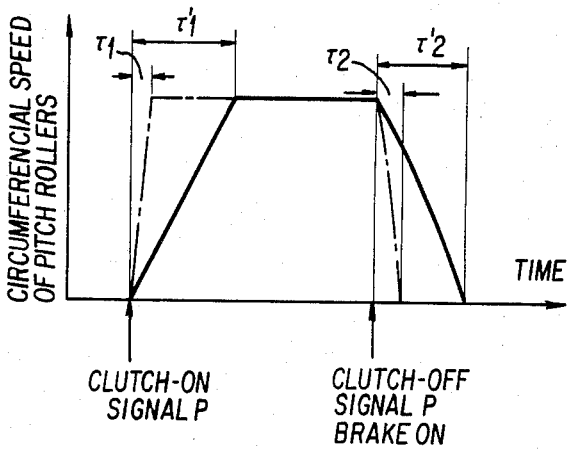
FIG. 10 is a graphic illustration showing the differences in the operating characteristics of vacuum clutch brake and electromagnetic clutch brake.

In the case of the vacuum clutch brake 8', the time $\tau 1$ for coupling the clutch as well as the time of deceleration $\tau 2$ after release of the clutch is shortened markedly as compared with the coupling time $\tau' 1$ and decelerating time $\tau' 2$ of the electromagnetic clutch brake as shown diagrammatically in FIG. 10. More specifically, the coupling and deceleration time lengths $\tau 1$ and $\tau 2$ are shortened to 30 msec in the case of the vacuum clutch brake from $\tau' 1$ and $\tau' 2$ of 120 msec of the electromagnetic clutch brake.

Figure 11:
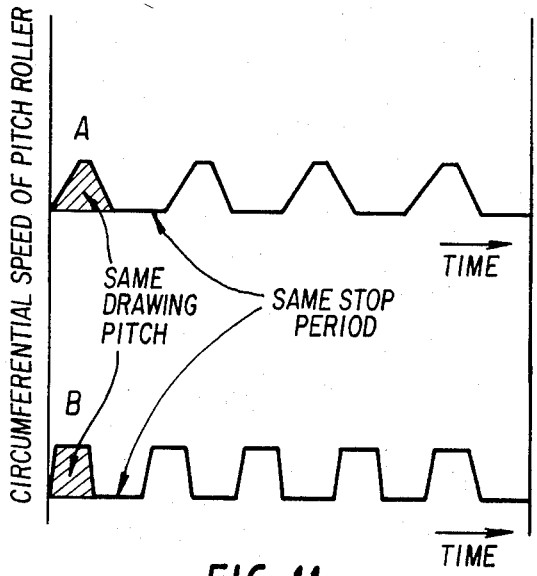
FIGS. 11(A) and 11(B) are diagrams of cycle times of electromagnetic and vacuum clutch brakes operating at the same withdrawing speed and with the same push-back time.

Therefore, as clear from comparison of FIGURES 11(A) and 11(B) which show the control of the casting withdrawal by an electromagnetic clutch brake and a vacuum clutch brake 8' employing the same withdrawing speed and push-back time, the drawing pitch in each cycle of casting withdrawal can be minimized by the use of the vacuum clutch brake 8'. Therefore, it becomes possible to perform five cycles of the casting withdrawing operation within a time period in which only four cycles have been possible with the electromagnetic clutch brake, thus permitting a greater number of cycles of the drawing operation for a given time length.

As a matter of fact, the vacuum clutch brake can achieve the efficiency of up to 150 c.p.m. at maximum in contrast to the maximum drawing cycles of 70 c.p.m. by the electromagnetic clutch brake. Therefore, for example, it becomes possible to carry out the casting withdrawal of a 15 mm pitch at the efficiency of 120 c.p.m. Although the drawing speed is limited depending upon the cooling capacity (shell solidifying speed) of the mold, the drawing pitch in each cycle of operation can be minimized owing to the increase in the number of cycles, to reduce the cold shut and to improve the quality of the cast product.

As clear also from FIG. 10 or from comparison of FIGS. 11(A) and 11(B), the vacuum clutch brake 8' can reduce the drawing time as compared with the electromagnetic clutch brake in a withdrawing operation at a given speed. In other words, in the case of the electromagnetic clutch brake involving a longer drawing time, flows are aroused in the molten metal by the drawing action for a longer time period to delay the effective formation of a solidified shell around the skin of the casting. On the other hand, the vacuum clutch brake can perform each cycle of drawing operation without redundant time losses, so that it can limit the flows of the molten stock to a shortened time period to cool the shell effectively, increasing the thickness of the shell acceleratedly to reduce the possibilities of breakout and stabilize the operation.

Needless to say, in order to prevent slips between the casting 2 and the pinch rollers 1*a* and 1*b*, the roller pressure control as described in connection with FIGS. 5 and 6 may be incorporated into the embodiment of FIG. 7 although omitted from illustration.

As clear from the foregoing description, the present invention provides a drawing apparatus for horizontal continuous casting machines, which basically comprises a forward drive motor of a large capacity for driving a pair of pinch rollers in a forward direction with a large torque, a reversible constant-load motor for driving the pinch rollers in the reverse direction, a clutch for disconnectibly connecting the forward drive motor to the pinch rollers, a control circuit for engaging and releasing the clutch in response to output signals of detecting means which detect the forward and backward motions of the casting, respectively. The forward and reverse drive motors are constantly held in rotation, and the withdrawal and push-back of the casting is effected alternately by connecting and disconnecting the forward drive motor to and from the pinch rollers through on-off operation of the clutch. Therefore, according to the present invention, there is no necessity for stopping and re-starting the drive motor at the time of reversing the direction of rotation of the pinch rollers, namely, it becomes possible to control the switching operation in a facilitated manner and with a higher response. Besides, the casting drawing apparatus of the invention can achieve a more accurated control of the withdrawal and push-back of the casting strand and thus can contribute to the stabilization in quality of the cast products.

What is claimed is:

1. A horizontal type continuous casting apparatus including a means for withdrawing the cast strand, said apparatus comprising in combination:

a pair of pinch rollers;

a forward drive motor of a large capacity for driving said pinch rollers in a forward direction;

a clutch for disconnectedly connecting said forward drive motor to said pinch rollers;

a reversible constant-load motor for driving said pinch rollers in a reverse direction;

strand motion detectors for detecting forward and backward movements of said cast strand; and a control means for engaging and releasing said clutch in response to output signals of said motion detection means.

2. An apparatus as set forth in claim 1, wherein said forward and reverse drive motors are constituted by an electric motor and an air motor, respectively, and are adapted to drive said pinch rollers through a reducer and universal joints.

3. An apparatus as set forth in claim 1, wherein said motion detector comprises a pulse generator adapted to produce positive and negative pulses in response to forward and backward motions of said cast strand.

4. An apparatus as set forth in claim 2, wherein said control means comprises a pulse discriminator for discriminating the positive and negative pulses produced by said pulse generator, a withdrawing stroke preset counter for counting said positive pulses up to a count corresponding to a required amount of casting withdrawal, a push-back stroke preset counter for counting said negative pulses up to a count corresponding to a required push-back amount, a withdrawal limit timer presetting a withdrawing time period T1, a push-back limit timer presetting a push-back time period T2, a flip-flop adapted to be set and produce a clutch-off signal upon count-up of said withdrawing stroke preset counter and to be reset and produce a clutch-on signal upon count-up of said push-back limit timer or time-out of said push-back limit timer.

5. An apparatus as set forth in claim 1, further comprising a roller pressure control means for adjusting the gripping force of said pinch rollers to prevent slips between said cast strand and pinch rollers, said pressure control including a roller pressurizer, a roller rotation detector for detecting the rotational angles of said pinch rollers, a comparator for detecting the difference between the output signals of said roller rotation detector and said strand motion detector, and a roller pressure controller for controlling the pressure to be applied on upper one of said pinch rollers by said roller pressurizer.

6. An apparatus as set forth in claim 1, wherein said clutch is constituted by a vacuum clutch brake provided between an output shaft of said forward drive motor and an input shaft of a coupling for connecting said forward drive motor to said pinch rollers.

7. An apparatus as set forth in claim 6, wherein said vacuum clutch brake comprises:

a housing divided by a partition wall into a coupling chamber accommodating a clutch shoe mounted on the end portion of said output shaft of said forward drive motor and a clutch disc and brake shoe mounted on the end portion of said input shaft of said coupling, and a vacuum chamber divided into first and second vacuum chambers by a diaphragm plate hermetically secured to the circumference of said input shaft of said coupling;

a vacuum source; and an solenoid valve having a neutral position, an on-position connecting one of said vacuum chambers with said vacuum source to engage said clutch, and an off-position for releasing said clutch and pressing said brake shoe against one side of said partition wall.

* * * * *